United States Patent [19]

Renard

[11] Patent Number: 4,785,886

[45] Date of Patent: Nov. 22, 1988

[54] METHOD OF PRODUCING A FLUID CONTAINED IN A GEOLOGICAL FORMATION COMPRISING SEVERAL FLUIDS

[75] Inventor: Gérard Renard, Rueil-Malmaison, France

[73] Assignee: Institut Francais du Petrole, Rueil-Malmaison, France

[21] Appl. No.: 671,919

[22] Filed: Nov. 15, 1984

[30] Foreign Application Priority Data

Nov. 18, 1983 [FR] France ..... 83 18353

[51] Int. Cl.[4] ..... E21B 43/12

[52] U.S. Cl. ..... 166/370; 166/50

[58] Field of Search ..... 166/50, 52, 369, 370, 166/313; 175/61, 62; 405/36

[56] References Cited

U.S. PATENT DOCUMENTS

| | | | |
|---|---|---|---|
| 2,855,047 | 8/1955 | Widmyer | 166/313 X |
| 2,889,880 | 6/1959 | Hughes | 166/313 |
| 2,925,097 | 2/1960 | Duestenberg | 166/313 X |
| 4,410,216 | 10/1983 | Allen | 166/50 X |
| 4,434,849 | 3/1984 | Allen | 166/50 X |
| 4,534,143 | 8/1985 | Goines et al. | 405/36 X |
| 4,574,884 | 3/1986 | Schmidt | 166/50 X |

*Primary Examiner*—George A. Suchfield

*Attorney, Agent, or Firm*—Antonelli, Terry & Wands

[57] ABSTRACT

A method is provided for producing at least a first fluid or desired fluid contained in a geological formation this formation further comprising at least a second fluid, or undesired fluid, which risks hindering production of the desired fluid, this latter being produced by means of at least one deflected or substantially horizontal drain.

According to this method, a second drain is disposed in said geological formation, this second drain being situtated between the first drain and the undesired fluid for drawing off a part at least of the undesired fluid and allowing the first drain to produce essentially the desired fluid.

14 Claims, 2 Drawing Sheets

METHOD OF PRODUCING A FLUID CONTAINED IN A GEOLOGICAL FORMATION COMPRISING SEVERAL FLUIDS

BACKGROUND OF THE INVENTION

1. Field of the Invention

The present invention relates to a method for producing at least one fluid contained in a geological formation by means of substantially horizontal drains, when this formation contains at least a second fluid which risks hindering production of the first.

In this description, the term "drain" is essentially used for designating an artificial well serving for draining a formation, this well possibly comprising over a portion of its length at least one perforated tube.

However, the present invention may be applied to a natural drain, if it has an appropriate form and layout.

2. Description of the Prior Art

When it is desired to produce one of two fluids present, for example oil, there occurs under the effect of the pressure gradient due to the desired flow of the fluid to be recovered, a deformation of the surface separating the two fluids which will be termed ridge effect. This is described in the article by Mr. GIGER entitled "EVALUATION THEORIQUE DE L'EFFET D'ARETE D'EAU SUR LA PRODUCTION PAR PUITS HORIZONTAUX" published in the revue of the French petroleum institute vol. 38, No 3, pages 361-370, May-June 1983, Paris (France). This ridge effect may cause a breakthrough of the undesired fluid and, consequently, the production of the undesired fluid in considerable proportions which may adversely effect working of the oil from an economic point of view.

The present invention avoids this disadvantage.

The prior art may be illustrated by the following U.S. Pat. Nos. 2,889,880; 3,638,731 and 2,855,047.

The methods described in these prior patents require the formation impregnated by the different fluids (gas, oil, water) to have passing therethrough the same oil used for producing the desired fluid, even if the production is made selective by addition of plugs and tubes.

These methods are defective and without effect if the geological formation is brought into yield by means of horizontal or very slanted drains.

More precisely, the present invention provides a method for producing a first fluid or desired fluid contained in a geological formation, this formation further comprising at least a second fluid or undesired fluid which risks hindering production of the first fluid, this first fluid being produced by means of at least one deflected or substantially horizontal first drain.

SUMMARY OF THE INVENTION

The method of the invention consists in disposing at least a second deflected or substantially horizontal drain in said geological formation, this second drain being situated between the first drain and the undesired fluid so as to produce a part at least of the undesired fluid and so as to allow the first drain to produce at least partially the desired fluid and preferably essentially the desired fluid.

The second drain may be situated, at least over a part of its length, in the desired fluid.

The second drain may also be placed, at least over a portion of its length, at the interface defined by the contact surface of the desired fluid and of the undesired fluid.

Similarly, the second drain may be situated at least partially in the undesired fluid.

The second drain will be placed advantageously so as to be substantially parallel to the first drain over at least a portion of its length.

In the case where the desired fluid is included between two other fluids likely to hinder the production, several drains may be disposed in accordance with the invention between the first drain, for producing the desired fluid and the other fluids so as to draw off a part at least of these other two fluids.

It is of course possible, in accordance with the invention, to use several drains for producing the first fluid.

BRIEF DESCRIPTION OF THE DRAWINGS

The present invention will be better understood and its advantages will appear more clearly from the following description which is now limitative and which is illustrated by the accompanying Figures in which.

DESCRIPTION OF THE PREFERRED EMBODIMENTS

Figure 1:
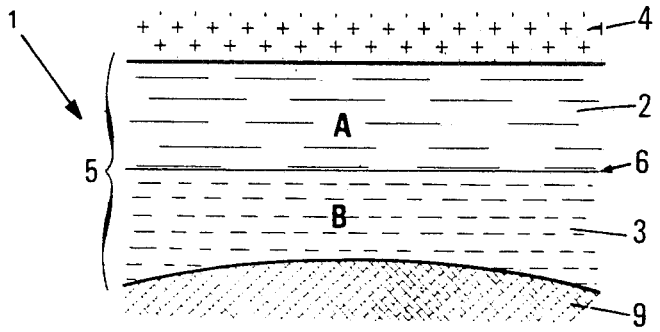
FIG. 1 illustrates a geological formation comprising two fluids.

The following embodiment of the present invention relates to the case of a geological formation 1 containing several immiscible fluids, for example at least two fluids, a first fluid A, such as oil, designated by the reference numeral 2 in FIG. 1 and a second fluid B, such as water, designated by reference numeral 3. The impermeable geological formation which forms the roof of the reservoir containing fluids A and B is designated by the reference numeral 4.

Fluids A and B, particularly, because of their difference in density are separated vertically inside layer 5.

Reference numeral 6 designates the interface between the two fluids A and B.

Figure 2:
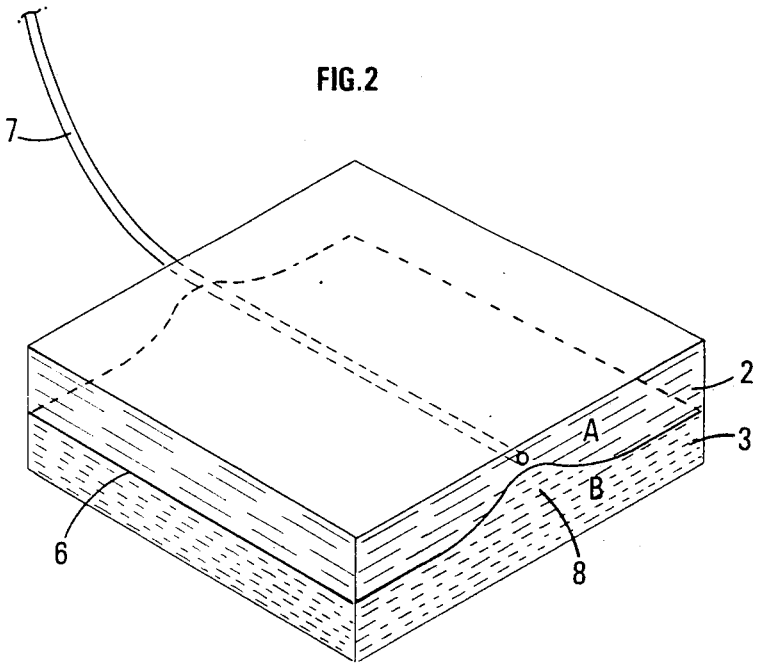
FIG. 2 illustrates schematically the deformation of the interface separating the two fluids during production of one of them by means of a horizontal drain.

When it is desired to produce only one of the two fluids, fluid A for example, by means of at least one horizontal production drain 7 (FIG. 2), a deformation 8 of the interface 6 separating the two fluids appears under the effect of the pressure gradient due to the flow of the fluid to be recovered. Interface 6 tends to draw closer to the horizontal production drain 7.

This phenomenon, which will be termed ridge effect, may cause a breakthrough of the undesired fluid B and two-phase production which may make working of the desired fluid A economically not worth while.

Numerous studies, by calculation or by using physical or analogical models, have shown that this phenomenon appears for a certain value of the drawing off flow-rate of fluid A to be produced, called critical flow.

It can be observed that as long as the flow of drain 7 remains lower than the critical flow, the surface separating the two fluids tends towards a stable position and does not reach drain 7. Thus, drain 7 produces only the desired fluid A.

Figure 3:
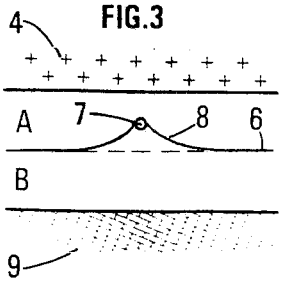
FIGS. 3 to 5 show how the production of a fluid to be worked is by the presence of fluids.
Figure 4:
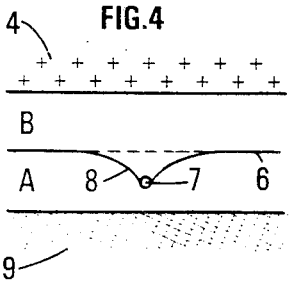

When the flow exceeds the limit of the critical flow, the surface 8 separating the two fluids reaches drain 7 which begins to produce simultaneously fluids A and B as is shown in FIG. 3 in the case where fluid A to be produced is less dense than fluid B. FIG. 4 illustrates the opposite case, that is to say when the fluid A to be produced is denser than fluid B.

In these two cases, the interface 6 is deformed from the initial position shown with a broken line to reach the production drain 7 and thus hinder the production of fluid A. In some cases, drain 7 may produce mostly the undesired fluid B.

Several formulae have been proposed for characterizing the critical flow. Built up-from typical groups of physical variables, these formulae bring out an important parameter: the distance between the perforations of drain 7 and the initial separation plane 6 of the two fluids A and B (water clearance when fluid B is water).

So as to eliminate or reduce this ridge formation phenomenon and to increase the clearance from the undesired fluid, and the value of the critical flow, a method is proposed whose description follows.

The part of the reservoir rock which contains fluid A which it is desired to produce is brought into yield by means of at least one horizontal drain 7, with a drawing off flow which causes the deformation 8 of the separation surface 6 of the two fluids A and B present.

The horizontal drain 7 intended for producing the desired fluid A is drilled preferably as far as possible from surface 6 separating the two fluids A and B present.

If fluid A which it is desired to produce is less dense than fluid B, the production will take place in the upper part of the zone to be produced. On the other hand, if the fluid A to be produced is denser than fluid B, the horizontal drain bringing the fluid A to the surface will be drilled in the lower part of the zone to be produced.

Figure 5:
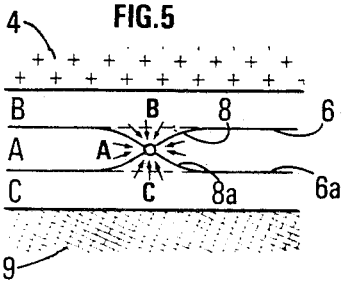

In the case where fluid A to be produced is situated in a zone of the reservoir rock between a zone containing a fluid B less dense than fluid A and a zone containing a fluid C denser than fluid A (FIG. 5), the horizontal drain for producing fluid A will be drilled approximately at equal distances from the separation surfaces of fluids 6 and 6A respectively (see FIG. 5).

However, this position is not imperative. It is also possible to position the production drain by taking into account the characteristics related to the different fluids, such as density, viscosity, . . .

The method proposed consists in bringing into production, simultaneously with the bringing into production of the zone containing fluid A which it is desired to recover, the zone containing fluid B which forms an obstacle to the production of fluid A in the horizontal drain drilled for this purpose.

The production of the undesired fluid B and/or C will take place through at least a second substantially horizontal drain 10 separate from the preceding one.

This additional drain intended to modify the pressure field, so the flows of the fluids in the vicinity of the horizontal drain 7 for producing fluid A, will be drilled substantially parallel to the preceding one so as to have constant efficiency over the whole width of the drain 7 brought into production.

The position of this additional drain 10 and the drawing off flow which it will convey may be advantageously determined by means of numerical models simulating the polyphase flows in the porous media, so that the proportion of undesired fluid B in the production of drain 7 producing fluid A is minimum.

EXAMPLE OF IMPLEMENTING THE METHOD

1. A substantially horizontal drain 7 is drilled in the zone containing the fluid A which it is desired to produce.

2. Depending on the drawing off rate desired in this horizontal drain 7, the number, position and drawing off rate of other horizontal drains 10 to be drilled are determined if required for example by using numerical models, so as to eliminate or reduce the proportion of undesired fluids in drain 7 the desired fluid.

3. The additional drains defined a step 2 are drilled either from wells already existing or from new wells.

4. The drain intended to produce the desired fluid A is brought into production depending on the desired flow rate.

5. The other drains are brought into production for eliminating or limiting the production of undesired fluid B in the drains brought into production at step 4.

6. Adjustment of the flow rate of the drains brought into production at step 5 so that the proportion of undesired fluids in drain 7 brought into production at 4 is at a minimum.

Figure 6:
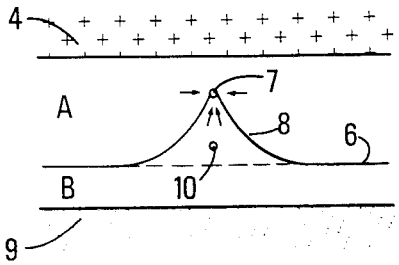
FIGS. 6 to 11 illustrate schematically the method of the present in different cases.
Figure 8:
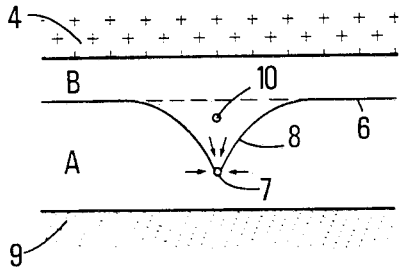
Figure 10:
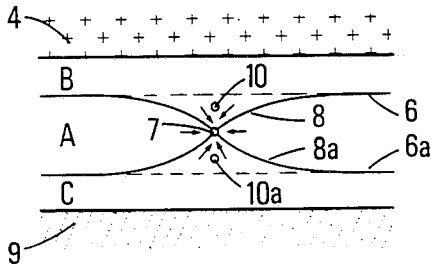

FIGS. 6, 8 and 10 show three possible configurations of the geological formation to be worked, either respectively the case where the desired fluid A has a density less than that of the undesired fluid B, the opposite case, that is to say when the density of fluid A is greater than that of fluid B and finally, the case where the desired fluid A has a density greater than that of a first undesired fluid B but less than that of a second undesired fluid C.

In these three Figures have been shown the additional drain or drains 10 and 10*a* intended to produce at least partially the undesired fluid or fluids.

It will be noted that in these three Figures the case has been shown where drain 7 is brought into production and not the drawing off drain 10. This explains that the undesired fluid or fluids B or C reach the production drain 7 of the desired fluid A.

Furthermore, it will be noted that in the three FIGS. 6, 8 and 10 the drain or drains 10, 10*a* for drawing off the undesired fluids B and/or C have been placed in the desired fluid A and, preferably, proximate the separation surface before working shown with broken lines.

Still within the scope of the invention, the drawing off drain or drains 10 may be placed substantially on the separation surface or surfaces of the fluids (A/B and/or A/C), before working, or in the undesired fluid or fluids B and/or C, over at least a portion of their length.

The distances separating the different drains from each other and the drains from the interfaces defined by the different fluids (A, B and C), as well as the drawing off and production rates may be determined depending on the characteristics of the formation, of the fluids, and/or of the equipment used for working, more particularly for optimizing the production of the desired fluid A and possibly minimizing the drawing off of the undesired fluid or fluids or minimizing the proportion of the desired fluid A produced by the drawing off drain or drains 10.

Figure 7:
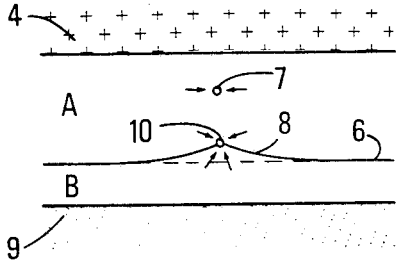
Figure 9:
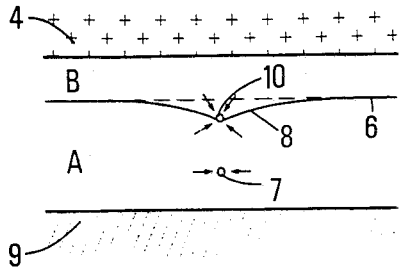
Figure 11:
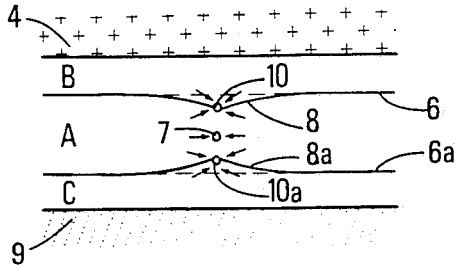

FIGS. 7, 9 and 11 correspond to FIGS. 6, 8 and 10, the difference residing in the method of working the drawing off drains.

During drawing off, the interfaces 8 and 8*a* are deformed in the vicinity of drains 10 which produce, as shown by the arrows, a portion at least of the undesired fluid B or C. Thus, the production drains 7 produce esentially a desired fluid A, as shown by the arrows.

Still within the scope of the invention, the different separation surfaces between the fluids and those separating the fluids and the walls of the geological formation may not be horizontal. In this case, the different drains may be placed parallel to these surfaces.

Of course, it is possible in accordance with the invention to use several drains 7 for producing the desired fluid A.

It is also possible in accordance with the invention to bring first of all into production the drains 7 for producing the desired fluid A then during working from a certain moment which may correspond for example to a critical deformation of interface 6, the drawing off drains 10 may be worked.

What is claimed is:

1. A method for producing at least a first fluid, or desired fluid contained in a geological formation, this formation further comprising at least a second fluid or undesired fluid which risks hindering the production of the desired fluid, this latter being produced by means of at least one deflected or substantially horizontal drain, which method consists in disposing a second deflected or substantially horizontal drain in said geological formation, situating the second drain between the first drain and the undesired fluid for drawing off part at least of the undesired fluid and allowing the first drain to produce said desired fluid at least partially.

2. The method as claimed in claim 1, wherein said second drain is situated, at least, over a part of its length in said desired fluid.

3. The method as claimed in claim 1, wherein said second drain is placed substantially on the interface designed by the contact surface of said fluids before working.

4. The method as claimed in claim 1, wherein said second drain is situated, at least partially, in said undesired fluid.

5. The method as claimed in one of the preceding claims, wherein said second drain is substantially parallel to said first drain over at least a portion of its length.

6. The method as claimed in one of claims 1 to 5 applied to the case where the desired fluid is included between two other fluids, wherein several drains are disposed between said first drain and said other fluids for drawing off a part at least of the two other fluids.

7. The method according to one of claims 1 to 5, wherein several drains are used for producing said desired fluid.

8. A method for producing at least a first fluid contained in a geological formation, said formation also containing at least a second fluid which is immiscible with the first fluid and which forms an interface with said first fluid, said second fluid tending to hinder the production of the first fluid, which comprises disposing at least one deflected or substantially horizontal first drain in said geographical formation within said first fluid; disposing a second deflected or substantially horizontal drain in said geographical formation, situating said second drain between the first drain and the second fluid for drawing off a part of at least the second fluid; and causing the first drain to produce said first fluid.

9. The method according to claim 8, wherein said second drain is disposed at least over a part of its length in said first fluid.

10. The method according to claim 8, wherein said second drain is disposed substantially at the interface formed by the contact surface of said first and second fluids before working of the geographical formation.

11. The method according to claim 8, wherein said second drain is disposed, at least partially, in said second fluid.

12. The method according to claim 8, wherein said second drain is disposed substantially parallel to said first drain over at least a portion of the length of the second drain.

13. The method according to claim 8, wherein the first fluid is arranged between two other immiscible fluids and wherein several other drains are disposed between said first drain and said other fluids for drawing off a part of at least the other fluids.

14. The method according to claim 8, wherein several first drains are used for producing said first fluid.

* * * * *